US006416288B1

(12) United States Patent
Song

(10) Patent No.: US 6,416,288 B1
(45) Date of Patent: Jul. 9, 2002

(54) AXIAL-FLOW FAN

(75) Inventor: Sung Bae Song, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/757,606

(22) Filed: Jan. 11, 2001

(30) Foreign Application Priority Data

Jul. 27, 2000 (KR) ..... 2000-43411

(51) Int. Cl.[7] ..... F04D 29/38

(52) U.S. Cl. ..... 416/234; 416/243; 416/DIG. 2; 416/DIG. 5

(58) Field of Search ..... 416/234, 243, 416/DIG. 2, DIG. 5

(56) References Cited

U.S. PATENT DOCUMENTS 4,789,306 A * 12/1988 Vorus et al. ..... 416/223 R
5,297,931 A * 3/1994 Yapp et al. ..... 415/208.1
6,325,597 B1 * 12/2001 Kim et al. ..... 416/238

* cited by examiner

*Primary Examiner*—Edward K. Look
*Assistant Examiner*—Ninh Nguyen
(74) *Attorney, Agent, or Firm*—Birch, Stewart, Kolasch & Birch, LLP

(57) ABSTRACT

Disclosed is an axial-flow fan including a hub coupled to a rotating shaft and integral with the rotating shaft, and blades arranged around the outer peripheral surface of the hub and integral with the hub, the axial-flow fan having design parameters given under the condition using an outer fan diameter of 110 mm±10 mm and a number of the blades corresponding to five or more. A sweep angle, which is included in the design parameters, is calculated using particular calculation equations, to reduce noises resulting from a "blade passing frequency" and a "blade vortex interaction" generated during an air sucking operation.

4 Claims, 8 Drawing Sheets

FIG. 6

| R | Rn | Sweep Angle(1) (Degree) | Sweep Angle(2) (Degree) | Sweep Angle(3) (Degree) |
|---|---|---|---|---|
| 18.9 | 0 | 0 | 0 | 28 |
| 19.78 | 0.025071 | 0.76 | 28 | 28 |
| 20.66 | 0.050142 | 1.52 | 28 | 28 |
| 21.53 | 0.074929 | 2.28 | 28 | 28 |
| 22.41 | 0.1 | 3.04 | 28 | 28 |
| 23.29 | 0.125071 | 3.8 | 28 | 28 |
| 24.16 | 0.149858 | 4.56 | 28 | 28 |
| 25.04 | 0.174929 | 5.32 | 28 | 28 |
| 25.92 | 0.2 | 6.07 | 28 | 28 |
| 26.8 | 0.225071 | 6.82 | 28 | 28 |
| 27.67 | 0.249858 | 7.57 | 28 | 28 |
| 28.55 | 0.274929 | 8.32 | 28 | 28 |
| 29.43 | 0.3 | 9.06 | 28 | 28 |
| 30.31 | 0.325071 | 9.8 | 28 | 28 |
| 31.18 | 0.349858 | 10.54 | 28 | 28 |
| 32.06 | 0.374929 | 11.28 | 28 | 28 |
| 32.94 | 0.4 | 12.01 | 28 | 28 |
| 33.82 | 0.425071 | 12.73 | 28 | 28 |
| 34.7 | 0.450142 | 13.46 | 28 | 28 |
| 35.57 | 0.474929 | 14.17 | 28 | 28 |
| 36.45 | 0.5 | 14.89 | 28 | 28 |
| 37.33 | 0.525071 | 15.66 | 28.06 | 28 |
| 38.21 | 0.550142 | 16.56 | 28.22 | 28 |
| 39.08 | 0.574929 | 17.54 | 28.46 | 28 |
| 39.96 | 0.6 | 18.61 | 28.79 | 28 |
| 40.84 | 0.625071 | 19.74 | 29.17 | 28 |
| 41.72 | 0.650142 | 20.93 | 29.62 | 28 |
| 42.59 | 0.674929 | 22.15 | 30.11 | 28 |
| 43.47 | 0.7 | 23.41 | 30.65 | 28 |
| 44.35 | 0.725071 | 24.69 | 31.21 | 28 |
| 45.23 | 0.750142 | 25.98 | 31.81 | 28 |
| 46.1 | 0.774929 | 27.29 | 32.44 | 28 |
| 46.98 | 0.8 | 28.59 | 33.08 | 28 |
| 47.86 | 0.825071 | 29.89 | 33.74 | 28 |
| 48.74 | 0.850142 | 31.18 | 34.41 | 28 |
| 49.61 | 0.874929 | 32.46 | 35.09 | 28 |
| 50.49 | 0.9 | 33.73 | 35.78 | 28 |
| 51.37 | 0.925071 | 34.97 | 36.48 | 28 |
| 52.25 | 0.950142 | 36.2 | 37.18 | 28 |
| 53.12 | 0.974929 | 37.4 | 37.88 | 28 |
| 54 | 1 | 38.57 | 38.57 | 28 |

AXIAL-FLOW FAN

BACKGROUND OF THE INVENTION

1. Field of the Invention

The present invention relates to an axial-flow fan, and more particularly to an axial-flow fan mounted to the electric unit of a microwave oven and adapted to cool the magnetron and high-voltage transformer of the microwave oven.

2. Description of the Conventional Art

Typically, an axial-flow fan includes a hub coupled to the rotating shaft of a motor fixedly mounted to the mounting section of a fan guide, and blades arranged around the hub and integral with the hub. The blades rotate along with the hub, thereby causing a fluid to flow axially.

Such an axial-flow fan have diverse design parameters depending on the appliance to which the axial-flow fan is applied. Where such design parameters are improperly determined, noises of an increased level are generated during an operation of the appliance to which the axial-flow fan is applied.

In particular, the axial-flow fan involves noises resulting from a blade vortex interaction(VBI) of the blades occurring during a rotation of those blades as a downstream one of the blades, which viewed in a rotation of the blades, is struck against a vortex stream created by an upstream one of the blades.

In the axial-flow fan, noises may also be generated due to the so-called blade passing frequency(BPF) of a fluid, passing the blades, exhibited when the fluid is struck against a fixed construction such as a guide fixedly mounted around the blades.

The blade passing frequency is expressed by an integer multiple of the product of the number of the blades by the revolutions per minute of the blades. Such a blade passing frequency is generated due to the striking of a fluid flow against the fixed construction around the blades occurring during the rotation of those blades. This blade passing frequency serves as a major frequency increasing the level of noises generated at the axial-flow fan.

Referring to FIG. 1, a microwave oven installed with a conventional axial-flow fan is illustrated. As shown in FIG. 1, the microwave oven includes a casing 1 defined with a cooking chamber 2. A magnetron 3 and a high-voltage transformer 5, which serve to generate microwaves, are mounted to the outer wall surface of the cooking chamber 2 at a desired portion of the cooking chamber 2. A waveguide 4 is arranged between the cooking chamber 2 and the magnetron 3 in order to guide microwaves to the cooking chamber 2. An axial-flow fan assembly 10 is fixedly mounted to the inner wall surface of the casing 1 at a desired portion of the casing 1 in order to cool the magnetron 3 and the high-voltage transformer 5.

As shown in FIG. 2, the axial-flow fan assembly 10 includes a suction guide 11 fixedly mounted to the inner wall surface of the casing 1 and adapted to assist in stably sucking a fluid, a drive motor 12 arranged upstream from the suction guide 11 and adapted to generate a rotating force, and an axial-flow fan 13 coupled to a rotating shaft of the drive motor 12 to receive the rotating force and adapted to suck air and to discharge the sucked air toward the magnetron 2 and the high-voltage transformer 5.

The axial-flow fan 13 is a fan axially sucking and discharging a fluid. This axial-flow fan 13 includes a hub 13*a* coupled to the rotating shaft of the drive motor 12 to receive a rotating force from the drive motor 12, and a plurality of blades 13*b* arranged around the hub 13*a* and integral with the hub 13*a* and adapted to move a fluid while rotating.

A general operation of the microwave oven including the above mentioned conventional axial-flow fan will now be described.

When the magnetron 3 generates microwaves in response to the application of electric power from the high-voltage transformer 5 thereto, the generated microwaves are supplied to the cooking chamber 2 via the waveguide 4, so that food disposed in the cooking chamber 2 is heated and cooked. Simultaneously, electric power is applied to the drive motor 12 adapted to drive the axial-flow fan 13 coupled to the rotating shaft of the drive motor 12, so that the axial-flow fan 13 rotates. During the rotation, the axial-flow fan 13 sucks ambient air, and discharges the sucked air toward the magnetron 3 and the high-voltage transformer 5, thereby preventing the magnetron 3 and the high-voltage transformer 5 from being overheated.

Now, design parameters for determining the structural shape of the axial-flow fan 13 will be described in detail.

As shown in FIG. 3A, the conventional axial-flow fan 13 has an outer fan diameter Df' of 108 mm and a hub diameter Dh' of 30 mm. The number of blades in the axial-flow fan 13 is four. Also, the axial-flow fan 13 has a sweep angle $\alpha'$ of 28°. The sweep angle is an angle defined between the line, which connects an intermediate point of the leading edge LE' of each blade with an intermediate point of the trailing edge TE' of the same blade between the outer peripheral surface of the hub and the tip of the blade, and a Y-axis perpendicular to a rotating axis of the blade, that is, a Z-axis.

The leading edge of each blade is positioned at a forward portion of the blade when viewed in the rotating direction of the fan, and the trailing edge of the blade is positioned at a rearward direction of the blade.

In FIG. 3B, "$\gamma'$" represents a rake angle, that is, an angle of each blade forwardly or rearwardly inclined with respect to the flow direction of a fluid passing through the axial-flow fan 13 when viewed from the side of the axial-flow fan 13, that is, along the X-axis. The flow direction of the fluid corresponds to ±Z-axis. The axial-flow fan 13 has a rake angle $\gamma'$ of 0°.

In FIG. 3C, "$\beta'$" represents a pitch angle of each blade in the axial-flow fan 13. The pitch angle is an angle defined between a phantom line, that is, a chord line C', extending between opposite blade tips when viewed from the side of the axial-flow fan 12, that is, along the X-direction, and the Y-axis perpendicular to the rotating axis of the blade, that is, the Z-axis. The axial-flow fan 13 has a pitch angle $\beta'$ of 21°±2° at the outer tip of each blade and 30°±2° at the inner tip of each blade.

The position of a camber line CB' connecting intermediate points between the upper and lower surfaces of each blade is expressed by a polynomial equation for the distance between the camber line CB' and the chord line C'. The position on the camber line CB' spaced apart from the chord line C' by a maximum straight distance is referred to as a "maximum camber position" MCP'. The maximum straight distance of the maximum camber position MCP' is referred to as a "maximum camber" MC'.

The ratio of the maximum camber MC' to the length of the chord line C' is referred to as a "maximum camber ratio" MCR'. The conventional axial-flow fan 13 has a maximum camber ratio of 5.2% at the outer blade tip and 7.2% at the inner blade tip. The maximum camber position MCP' is defined at a point spaced apart from both the leading edge LE' and the trailing edge TE' by a distance of 0.5±0.1 when the distance between the leading and trailing edges LE' and TE' is defined to be 1.

In the above mentioned axial-flow fan applied to microwave ovens, air sucked by the axial-flow fan exhibits the above mentioned "blade passing frequency" while passing by the suction guide arranged at the suction section of the axial-flow fan, thereby generating noises. The level of such noises is also increased due to a blade vortex interaction of the blades occurring during a rotation of those blades as a downstream one of the blades is struck against a vortex stream created by an upstream one of the blades.

SUMMARY OF THE INVENTION

Therefore, an object of the invention is to provide an axial-flow fan capable of reducing noises generated during a suction of air, in particular, noises resulting from a "blade passing frequency" and a "blade vortex interaction".

In accordance with the present invention, this object is accomplished by providing an axial-flow fan including a hub coupled to a rotating shaft and integral with the rotating shaft, and blades arranged around the outer peripheral surface of the hub and integral with the hub, wherein the number of blades, a pitch angle, a rake angle, a sweep angle, a maximum camber, and a maximum camber position, which are included in design parameters for determining structures of the hub and blades, are appropriately determined. In particular, the sweep angle is determined using specific mathematical equations.

In accordance with an embodiment of the present invention, the axial-flow fan comprises, as design parameters thereof: an outer fan diameter of 110 mm±10 mm; an inner/outer diameter ratio of 0.30 to 0.38, the inner/outer diameter ratio corresponding to a ratio of an outer hub diameter to the outer fan diameter; a number of the blades corresponding to five or more; a maximum camber ratio ranging from a value of 10.2 to 11.2% at an outer tip of each of the blades to a value of 4.2 to 5.2% at an inner tip of each of the blades; a maximum camber position defined at a point spaced apart from leading and trailing edges of each of the blades by a distance of 0.5±0.1 when the distance between the leading and trailing edges is defined to be 1; a pitch angle ranging from an angle of 30°±2° at the outer blade tip to an angle of 43°±2° at the inner blade tip; a rake angle ranging from 5.5° to 5.9°; and a sweep angle varying in a radial direction of the fan.

BRIEF DESCRIPTION OF THE DRAWINGS

FIG. 6 is a table describing a variation in sweep angle in the axial-flow fan of the present invention, and a variation in sweep angle in the conventional axial-flow fan.

DESCRIPTION OF THE PREFERRED EMBODIMENTS

Now, an axial-flow fan according to a preferred embodiment of the present invention will be described, with reference to the annexed drawings.

Figure 1:
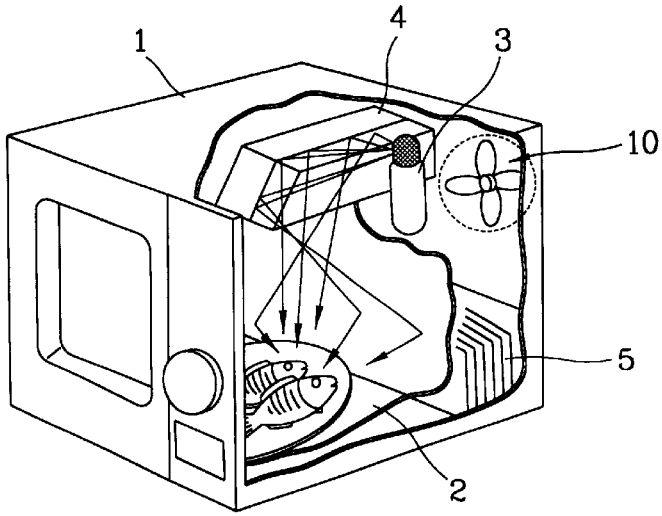
FIG. 1 CONVENTIONAL ART
FIG. 1 is a partially-broken schematic perspective view illustrating a general microwave oven.
Figure 2:
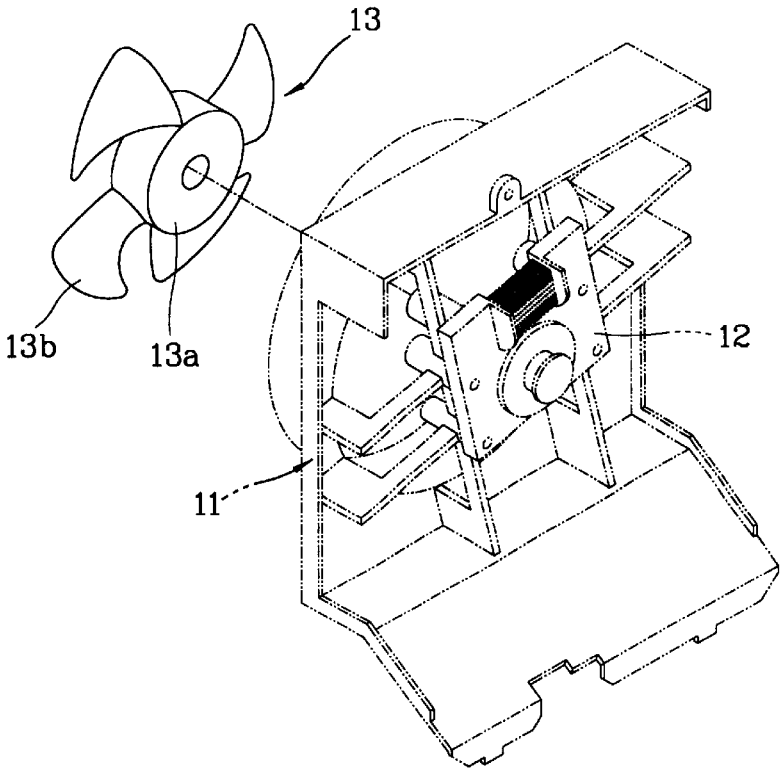
FIG. 2 CONVENTIONAL ART
FIG. 2 is an exploded perspective view illustrating a conventional axial-flow fan applied to the general microwave oven.
Figure 3A:
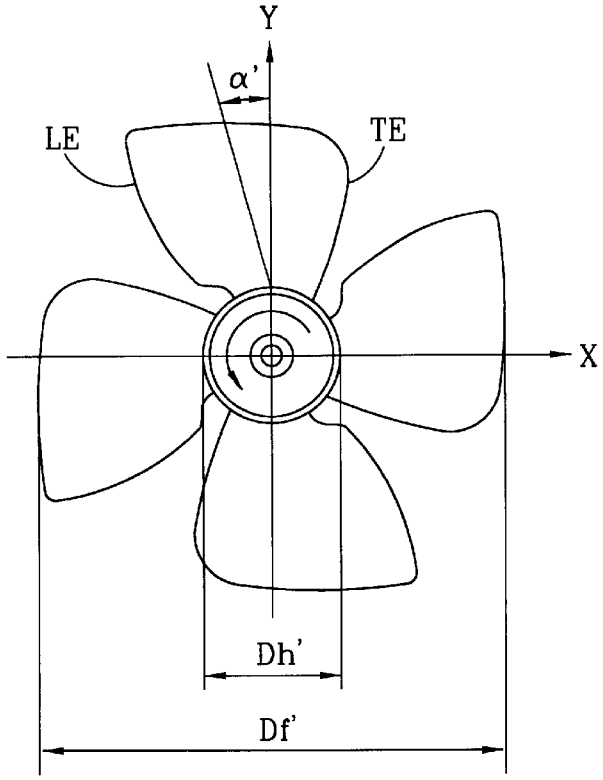
FIG. 3A CONVENTIONAL ART
FIG. 3A is a schematic view illustrating essential design parameters of the conventional axial-flow fan.
Figure 3B:
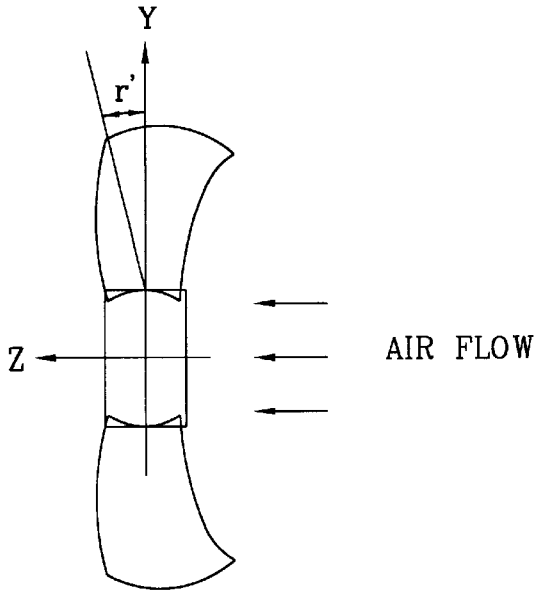
FIG. 3B CONVENTIONAL ART
FIG. 3B is a schematic view illustrating essential design parameters of the conventional axial-flow fan.
Figure 3C:
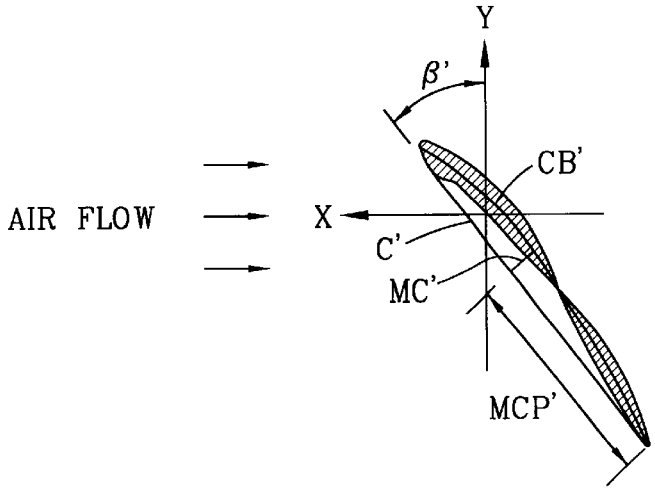
FIG. 3C CONVENTIONAL ART
FIG. 3C is a schematic view illustrating essential design parameters of the conventional axial-flow fan.
Figure 4:
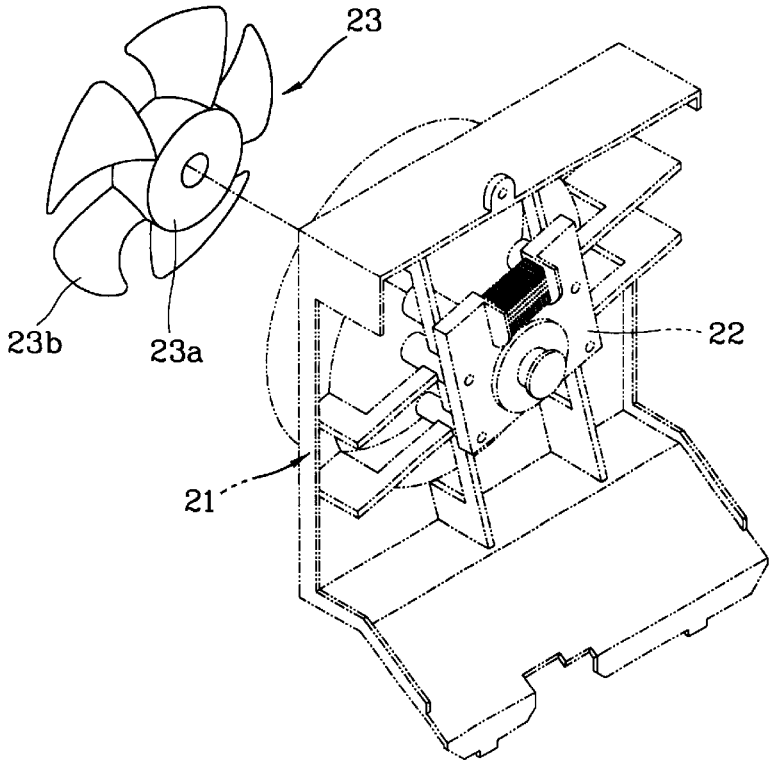
FIG. 4 is an exploded perspective view illustrating an axial-flow fan of the present invention applied to a microwave oven.

Referring to FIG. 4, an axial-flow fan for a microwave oven in accordance with an embodiment of the present invention is illustrated. As shown in FIG. 4, the axial-flow fan, which is denoted by the reference numeral 23, includes a hub 23*a* coupled to the rotating shaft of a drive motor 22 to receive a rotating force from the drive motor 22, and blades 23*b* arranged around the hub 23*a* and integral with the hub 23*a* and adapted to move a fluid.

The axial-flow fan 23 serves to axially suck and discharge a fluid.

Figure 5A:
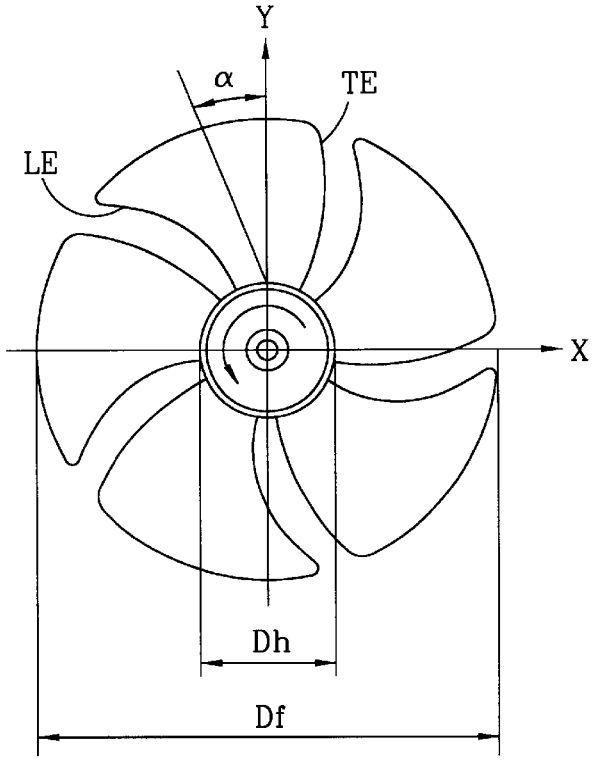
FIG. 5A is a schematic view illustrating essential design parameters of the axial-flow fan of the present invention.

As shown in FIG. 5A, the axial-flow fan 23 has an outer fan diameter Df of 110 mm±10 mm. The number of blades in the axial-flow fan 23 is five. Also, the axial-flow fan 13 has an inner/outer diameter ratio Dh/Df of 0.30 to 0.38.

Figure 5B:
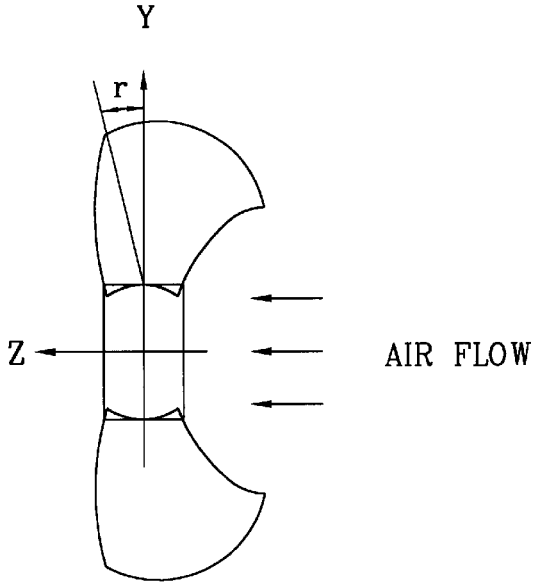
FIG. 5B is a schematic view illustrating essential design parameters of the axial-flow fan of the present invention.

In FIG. 5B, "γ" represents a rake angle of each blade forwardly or rearwardly inclined with respect to the flow direction (Z-axis) of a fluid passing through the axial-flow fan 23 when viewed from the side of the axial-flow fan 23. The axial-flow fan 23 has a rake angle γ of 5.5 to 5.9°.

Figure 5C:
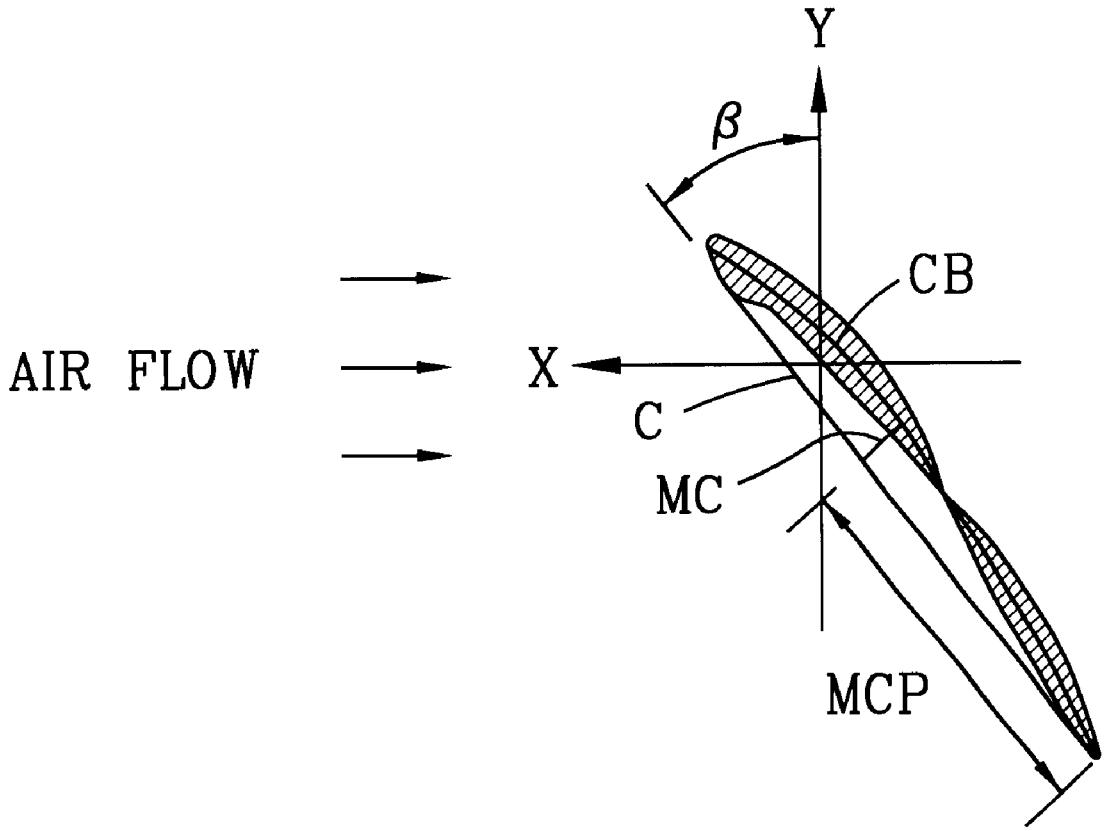
FIG. 5C is a schematic view illustrating essential design parameters of the axial-flow fan of the present invention.

In FIG. 5C, "β" represents a pitch angle of each blade defined between a phantom line, that is, a chord line C, extending between opposite blade tips when viewed from the side of the axial-flow fan 12, that is, along the X-direction, and an Y-axis perpendicular to the rotating axis of the blade, that is, the Z-axis. The axial-flow fan 23 has a pitch angle β of 30°±2° at the outer tip of each blade and 43°±2° at the inner tip of each blade.

The position of a camber line CB connecting intermediate points between the upper and lower surfaces of each blade is expressed by a polynomial equation for the distance between the camber line CB and the chord line C. The position on the camber line CB spaced apart from the chord line C by a maximum straight distance, that is, the maximum camber position MCP, is defined at a point spaced apart from both the leading edge LE and the trailing edge TE by a distance of 0.5±0.1 when the distance between the leading and trailing edges LE and TE is defined to be 1.

The ratio of the maximum camber MC to the length of the chord line C, that is, the maximum camber ratio MCR, ranges from 10.2 to 11.2% at the outer blade tip while ranging from 4.2 to 5.2% at the inner blade tip.

Referring to FIG. 5A, the axial-flow fan 23 also has a sweep angle α. The sweep angle α is an angle defined between the line, which connects an intermediate point of the leading edge LE of each blade with an intermediate point of the trailing edge TE of the same blade between the outer peripheral surface of the hub and the tip of the blade, and the Y-axis perpendicular to the rotating axis of the blade, that is, the Z-axis, under the condition in which the center of the hub coincides with the origin of the X-Y-Z-axis coordinates. The sweep angle α of the axial-flow fan 23 is determined as follows:

Assuming that the outer peripheral surface of the hub 23*a* is defined to have a value of 0, and the tip of each blade 23*b* is defined to have a value of 1, the distance of a point on the blade 23*b* from the outer peripheral surface of the hub 23*a* is defined by a value Rn, which is a positive integer, expressed as follows:

$$Rn = \frac{(R - Rh)}{(Rt - Rh)} \quad \text{[Equation 1]}$$

where, "R" represents the difference between the outer hub diameter and the outer fan diameter, "Rh" represents the hub radius, and "Rt" represents the fan radius.

Where "Rn" is less than "P1", the following equations are applied:

$$S=(Rt-Rh)\times\tan\delta\times(Rn\times Rn) \quad \text{[Equation 2]}$$

$$S=(Rt-Rh)\times\tan\delta\times Rn \quad \text{[Equation 2-1]}$$

On the other hand, where "Rn" is not less than "P1", the following equations are applied:

$$S=(Rt-Rh)\times\tan\delta\times(Rn\times Rn)+a\times Rn\times Rn+b\times Rn+c \quad \text{[Equation 3]}$$

$$S=(Rt-Rh)\times\tan\delta\times Rn+a\times Rn\times Rn+b\times Rn+c \quad \text{[Equation 3-1]}$$

In the above equations,

S: optional dummy

α: sweep angle

δ: basic sweep angle

P1: optional value within a range of 0.3 to 0.8 a: (Rt−Rh)×tan δ÷(1.0−P1)

b: −2×a×P1 c: −a×P1×P1−b×P1

In order to calculate a sweep angle α, the optional dummy S determined by the above equations is applied to the following equation:

$$\alpha = \tan^{-1}\left(\frac{S}{R - Rh}\right) \quad \text{[Equation 4]}$$

Equation 4 is obtained after converting an operation equation for a program into a general mathematical equation.

Now, an example implemented using the above mentioned equations will be described.

In association with an example using an outer fan diameter of 108 mm, an outer hub diameter of 37.8 mm, and a basic sweep angle of 28° as input dummies, "Rn" is derived by applying those input dummies to Equation 1.

Thereafter, the derived Rn is compared with the input dummy P1. The optional dummy S is then derived by applying the derived Rn to Equation 2 or 2-1 when the derived Rn is less than the input dummy P1 while applying the derived Rn to Equation 3 or 3-1 when the derived Rn is not less than the input dummy P1. The derived optional dummy S is then applied to Equation 4, thereby determining the distribution of the sweep angle α between the outer peripheral surface of the hub and the tip of each blade. In this example, Equations 2 and 3 are selected.

FIG. 6 is a table describing a variation in the sweep angle α exhibited in a radial direction of the axial-flow fan 23 and derived using the above mentioned equations according to the present invention and a variation in the sweep angle α' exhibited in a radial direction of the conventional axial-flow fan 13, under the condition using an outer fan diameter of 108 mm, an outer hub diameter of 37.8 mm, a basic sweep angle of 28°, a P1 value of 0.5.

The terms used in the table will now be described.

In the table, "R" represents a radius, that is, a radial distance from the outer peripheral surface of the hub to the tip of each blade defined under the condition using the outer fan diameter and outer hub diameter as defined as above.

"Rn" represents a variation in radius exhibited within a range from the outer peripheral surface of the hub to the tip of each blade and converted into a corresponding value within a range from 0 to 1.

In the example described in the table, Rn values are derived for 40 radial points sectioned from the range from the outer peripheral surface of the hub to the tip of each blade, respectively. In order to obtain an increased number of successive Rn values, the range from the outer peripheral surface of the hub to the tip of each blade may be correspondingly sectioned into an increased number of radial points.

In the table, "sweep angle (1)" represents a sweep angle α varying in the radial direction of the axial-flow fan 23 and derived using Equation 2 or 3 where "Rn×Rn" is to be applied.

That is, "sweep angle (1)" includes a sweep angle α exhibited at each radial point having an Rn value more than 0.5 and derived using Equation 2, and a sweep angle α exhibited at each radial point having an Rn value not more than 0.5 and derived using Equation 3.

In the table, "sweep angle (2)" represents a sweep angle α varying in the radial direction of the axial-flow fan 23 and derived using Equation 2-1 or 3-1 where "Rn" is to be applied.

That is, "sweep angle (2)" includes a sweep angle α exhibited at each radial point having an Rn value more than 0.5 and derived using Equation 2-1, and a sweep angle α exhibited at each radial point having an Rn value not more than 0.5 and derived using Equation 3-1.

In the table, "sweep angle (3)" represents a sweep angle α' exhibited in the conventional axial-flow fan.

Figure 7:
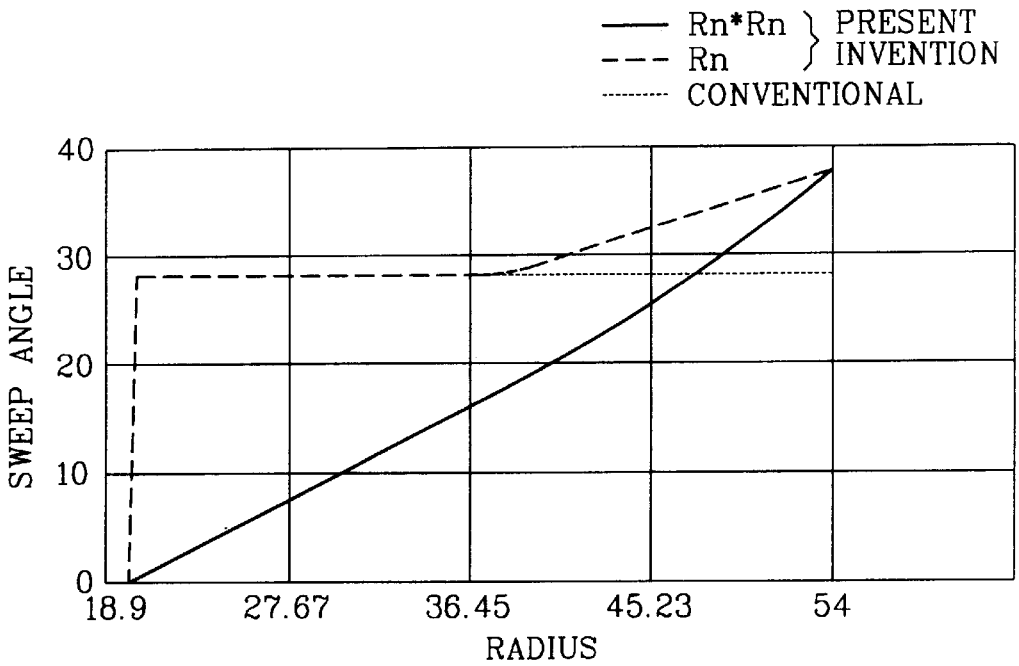
FIG. 7 is a graph for comparing a variation in sweep angle in the axial-flow fan of the present invention with a variation in sweep angle in the conventional axial-flow fan.

FIG. 7 is a graph for comparing a variation in the sweep angle α expressed by the equations of the present invention with a variation in the sweep angle α' exhibited in the conventional axial-flow fan.

In FIG. 4, the reference numeral 21 denotes a suction guide.

Now, the operation of a microwave oven, to which the axial-flow fan according to the illustrated embodiment of the present invention is applied, will be described.

When a magnetron generates microwaves in response to the application of electric power from a high-voltage transformer thereto, the generated microwaves are supplied to a cooking chamber defined in the microwave oven, so that food disposed in the cooking chamber is heated and cooked. Simultaneously, electric power is applied to the drive motor 22 adapted to drive the axial-flow fan 23 coupled to the rotating shaft of the drive motor 22, so that the axial-flow fan 23 rotates. During the rotation, the axial-flow fan 23 sucks ambient air, and discharges the sucked air toward an electric unit installed on a casing of the microwave oven, thereby preventing the magnetron and the high-voltage transformer from being overheated.

Figure 8:
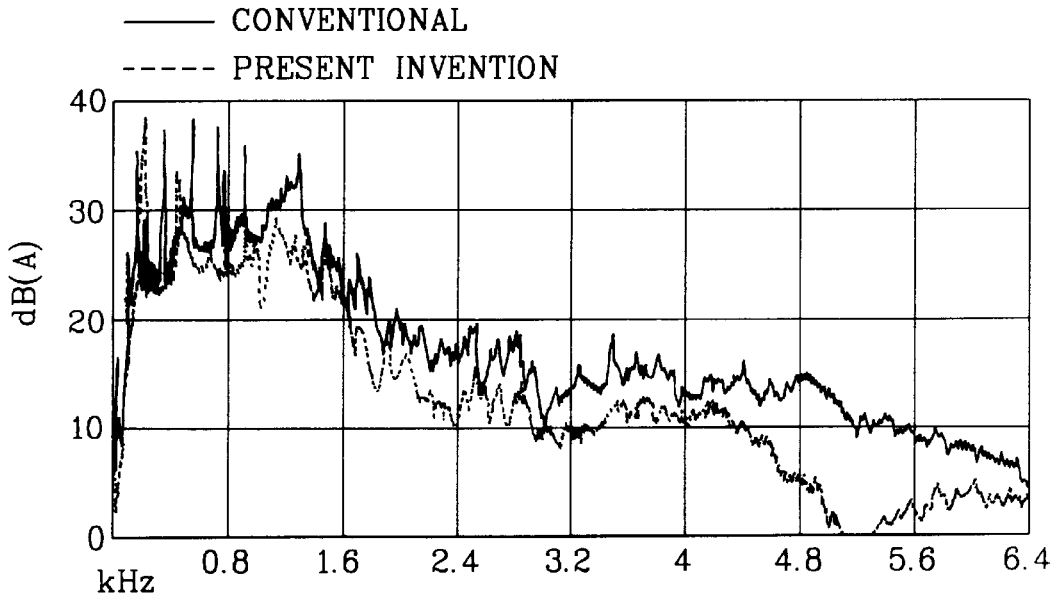
FIG. 8 is a graph for comparing a variation in noise spectrum exhibited in the axial-flow fan according to the present invention with a variation in noise spectrum exhibited in the conventional axial-flow fan.
Figure 9:
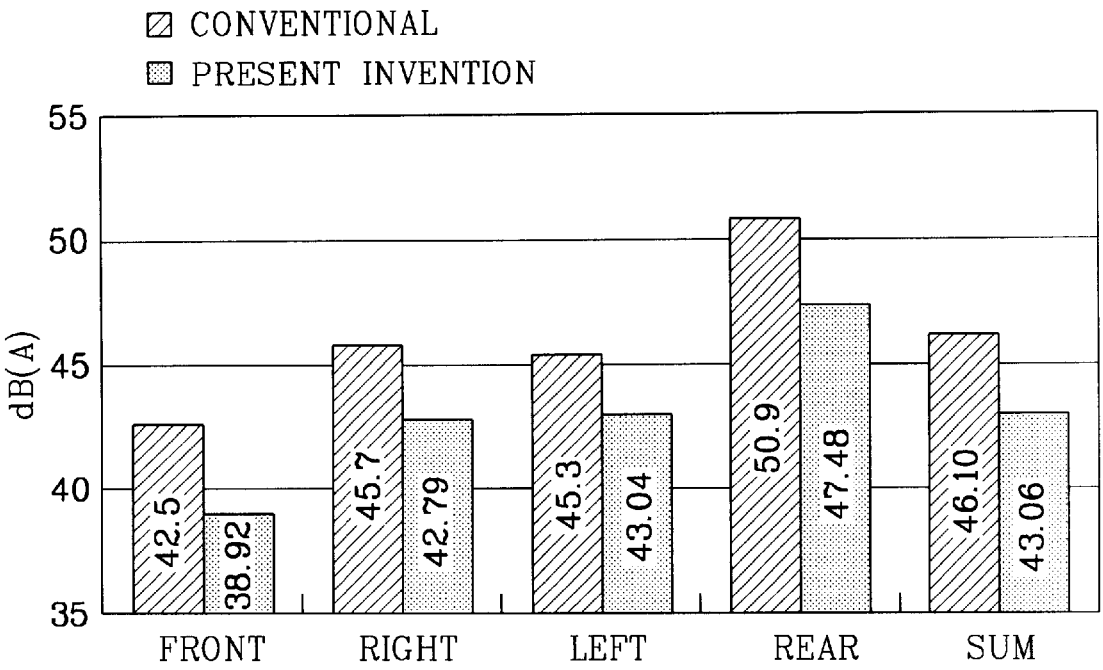
FIG. 9 is a graph depicting noises generated in the vicinity of the microwave oven for the case in which the axial-flow fan of the present invention is applied to the microwave oven, and the case in which the conventional axial-flow fan is applied to the same microwave oven.

During the operation of the axial-flow fan 23 for sucking ambient air, and discharging the sucked air toward the electric unit, noises are generated due to the above mentioned "blade passing frequency" and "blade vortex interaction". Referring to FIGS. 8 and 9, however, it can be found that the level of noises generated is reduced in the case using the axial-flow fan according to the present invention, as compared to the case using the conventional axial-flow fan.

FIG. 8 is a graph for comparing a variation in noise spectrum exhibited in the axial-flow fan according to the present invention with a variation in noise spectrum exhibited in the conventional axial-flow fan. Referring to FIG. 8, it can be found that the conventional axial-flow fan involves about 5 or 6 peaks of noises representing a generation of the blade passing frequency in a low-frequency band of 2 kHz or less where noises resulting from the blade passing frequency are remarkably generated. FIG. 8 also shows that the generation of noise peaks representing the generation of the blade passing frequency is considerably reduced.

Referring to FIG. 8, it can also be found that the axial-flow fan of the present invention exhibits a reduced noise level in the full frequency band, as compared to the conventional axial-flow fan. This means that where the axial-flow fan manufactured using the sweep angle calculation equations according to the present invention is applied to a microwave oven, it is possible to inhibit the generation of a blade passing frequency resulting from a striking of a downstream one of blades against a vortex stream created by an upstream one of the blades.

FIG. 9 is a graph depicting noises generated in the vicinity of the microwave oven to which the axial-flow fan of the present invention is applied. Referring to FIG. 9, it can be found that even when the axial-flow fan of the present invention is simply replaced for the conventional axial-flow fan used in the microwave oven having a conventional configuration, a reduction in the level of noises is achieved at all positions, that is, front, rear, left, and right positions, as compared to the case using the conventional axial-flow fan.

Although the above mentioned experimental results are associated with the case in which the axial-flow fan according to the illustrated embodiment of the present invention is applied to the microwave oven, the present invention can be applied to axial-flow fans of any types applied to appliances other than the microwave oven within design ranges defined in accordance with the present invention in association with outer fan diameter and outer hub diameter.

As apparent from the above description, the axial-flow fan according to the present invention provides various effects.

That is, the axial-flow fan of the present invention, which includes a hub coupled to a rotating shaft and integral with the rotating shaft, and blades arranged around the outer peripheral surface of the hub and integral with the hub, has a sweep angle distribution calculated by the above mentioned calculation equations. Here, the sweep angle is indicative of an angle defined between the line, which connects an intermediate point of the leading edge of each blade with an intermediate point of the trailing edge of the same blade between the outer peripheral surface of the hub and the tip of the blade, and a Y-axis perpendicular to a rotating axis of the blade, that is, a Z-axis. In accordance with this sweep angle distribution, it is possible to reduce, by an average of 3 dB(A), the level of noises resulting from a "blade passing frequency" and a "blade vortex interaction" generated during an air sucking operation. As a result, noises generated during the driving of the axial-flow fan are efficiently reduced.

Thus, it is possible to secure an improved quietness during the operation of an appliance to which the axial-flow fan of the present invention is applied.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An axial-flow fan including a hub coupled to a rotating shaft and integral with the rotating shaft, and blades arranged around the outer peripheral surface of the hub and integral with the hub, comprising, as design parameters thereof:

an outer fan diameter of 110 mm±10 mm;

an inner/outer diameter ratio of 0.30 to 0.38, the inner/outer diameter ratio corresponding to a ratio of an outer hub diameter to the outer fan diameter;

a number of the blades corresponding to five or more;

a maximum camber ratio ranging from a value of 10.2 to 11.2% at an outer tip of each of the blades to a value of 4.2 to 5.2% at an inner tip of each of the blades;

a maximum camber position defined at a point spaced apart from leading and trailing edges of each of the blades by a distance of 0.5±0.1 when the distance between the leading and trailing edges is defined to be 1;

a pitch angle ranging from an angle of 30°±2° at the outer blade tip to an angle of 43°±2° at the inner blade tip;

a rake angle ranging from 5.5° to 5.9°; and a sweep angle varying in a radial direction of the fan.

2. The axial-flow fan according to claim 1, wherein the sweep angle is determined, based on the following equations:

$$Rn = \frac{(R - Rh)}{(Rt - Rh)}$$

where,

"Rn" represents a variation in radius exhibited within a range from the outer peripheral surface of the hub to the outer blade tip and converted into a corresponding value within a range from 0 to 1, "R" represents a difference between the outer hub diameter and the outer fan diameter, "Rh" represents a hub radius, and "Rt" represents a fan radius;

1) $Rn<P1$:

$$S=(Rt-Rh)\times\tan\delta\times(Rn\times Rn)$$

2) $Rn\geq P1$ $$S=(Rt-Rh)\times\tan\delta\times(Rn\times Rn)+a\times Rn\times Rn+b\times Rn+c$$

3) $$\alpha = \tan^{-1}\left(\frac{S}{R - Rh}\right)$$

where,

S: an optional dummy

α: the sweep angle

δ: a basic sweep angle

P1: an optional value within a range of 0.3 to 0.8 a: $(Rt-Rh)\times\tan^{-1}\delta\div(1.0\times P1)$ b: $-2\times a\times P1$ c: $-a\times P1\times P1-b\times P1$.

3. The axial-flow fan according to claim 1, wherein the sweep angle is determined, based on the following equations:

$$Rn = \frac{(R-Rh)}{(Rt-Rh)}$$

where,

"Rn" represents a variation in radius exhibited within a range from the outer peripheral surface of the hub to the outer blade tip and converted into a corresponding value within a range from 0 to 1, "R" represents a difference between the outer hub diameter and the outer fan diameter, "Rh" represents a hub radius, and "Rt" represents a fan radius;

1) $Rn<P1$:

$$S=(Rt-Rh)\times\tan\delta\times(Rn)$$

2) $Rn\geqq P1$ $$S=(Rt-Rh)\times\tan\delta\times(Rn)+a\times Rn\times Rn+b\times Rn+c$$

3) $$\alpha=\tan^{-1}\left(\frac{S}{R-Rh}\right)$$

where,

S: an optional dummy

α: the sweep angle

δ: a basic sweep angle

P1: an optional value within a range of 0.3 to 0.8 a: $(Rt-Rh)\times\tan^{-1}\delta\div(1.0-P1)$ b: $-2\times a\times P1$ c: $-a\times P1\times P1-b\times P1$.

4. The axial-flow fan according to claim 2 or 3, wherein the basic sweep angle ranges within a range of 28°±5°.

* * * * *